US008302878B2

(12) United States Patent
Urmson, Jr. et al.

(10) Patent No.: US 8,302,878 B2
(45) Date of Patent: Nov. 6, 2012

(54) METHOD AND ARRANGEMENT TO INSULATE RAIL ENDS

(75) Inventors: W. Thomas Urmson, Jr., Valencia, PA (US); John M. Downey, Ashland, KY (US); Patrick J. Boario, Allegheny Township, PA (US); John W. Mospan, Pittsburgh, PA (US)

(73) Assignee: Koppers Delaware, Inc., Wilmington, DE (US)

( * ) Notice: Subject to any disclaimer, the term of this patent is extended or adjusted under 35 U.S.C. 154(b) by 0 days.

(21) Appl. No.: 13/037,483

(22) Filed: Mar. 1, 2011

(65) Prior Publication Data

US 2011/0147474 A1 Jun. 23, 2011

Related U.S. Application Data

(63) Continuation of application No. 11/375,372, filed on Mar. 14, 2006, now Pat. No. 7,975,933.

(60) Provisional application No. 60/661,853, filed on Mar. 14, 2005.

(51) Int. Cl.
*E01B 5/02* (2006.01)

(52) U.S. Cl. ..... 238/152; 238/153; 238/240; 238/241; 238/242

(58) Field of Classification Search ..... 238/151, 238/152, 153, 159, 223, 225, 226, 227, 228, 238/230, 231, 233, 234, 236, 240, 241, 242, 238/243

See application file for complete search history.

(56) References Cited

U.S. PATENT DOCUMENTS

| | | | | |
|---|---|---|---|---|
| 919,280 | A | 4/1909 | Akers | |
| 1,237,982 | A | 8/1917 | Wellendorf | |
| 2,130,106 | A | 3/1937 | Schermerhorn | |
| 2,472,446 | A | 9/1947 | Standfast | |
| 2,822,137 | A * | 2/1958 | Groseclose | 238/231 |
| 3,006,553 | A | 10/1961 | Greer | |
| 3,851,821 | A | 12/1974 | Lopez | |
| 3,952,948 | A | 4/1976 | Nelson et al. | |
| 4,485,967 | A | 12/1984 | Edwards | |
| 5,503,331 | A | 4/1996 | Urmson, Jr. et al. | |
| 5,533,670 | A * | 7/1996 | Chen | 238/187 |
| 5,842,637 | A | 12/1998 | Lanzer | |
| 6,581,351 | B2 * | 6/2003 | DeVivi | 52/592.1 |

FOREIGN PATENT DOCUMENTS

DE 3108339 A1 9/1982

OTHER PUBLICATIONS

Davis et al., "Prototype Next Generation Insulated Joints", Technology Digest, Mar. 2010, TD-10-009, Transportation Technology Center, Inc.

(Continued)

*Primary Examiner* — Mark Le
(74) *Attorney, Agent, or Firm* — The Webb Law Firm

(57) ABSTRACT

A rail joint arrangement comprises two rails. The rails have adjacent rail ends separated and thereby forming a gap. The rails have a top end containing a rail head and a bottom end. The gap is defined between the top end and the bottom end of the rails, and the width of the gap is non-uniform throughout its entire length. In addition, the rail joint arrangement comprises at least one electric insulator positioned within the gap. The rail joint arrangement is fastened together by a rail joint bar attaching the two rails together.

9 Claims, 5 Drawing Sheets

OTHER PUBLICATIONS

Akhtar et al., "Development of and Improved Performance Bonded Insulated Joint for HAL Service", Technology Digest, May 2006, TD-06-012, Transportation Technology Center, Inc.

Davis et al., "Analysis of Conventional and Tapered Bonded Insulated Rail Joints", Technology Digest, May 2006, TD-06-014, Transportation Technology Center, Inc.

Akhtar et al., "Preliminary Results of Prototype Insulated Joint Tests at FAST", Technology Digest, May 2007, TD-07-013, Transportation Technology Center, Inc.

Davis et al., "Evaluation of Improved Designs for Bonded Insulated Joints in HAL Service", Technology Digest, Jul. 2007, TD-07-020, Transportation Technology Center, Inc.

* cited by examiner

METHOD AND ARRANGEMENT TO INSULATE RAIL ENDS

CROSS REFERENCE TO RELATED APPLICATIONS

This application is a continuation of U.S. patent application Ser. No. 11/375,372 filed Mar. 14, 2006, now U.S. Pat. No. 7,957,933 which claims priority to U.S. Provisional Application No. 60/661,853, filed Mar. 14, 2005. The entire content of the above-referenced applications are incorporated herein by reference.

BACKGROUND OF THE INVENTION

1. Field of the Invention

The present invention relates to a rail joint arrangement and a method of forming a rail joint.

2. Description of Related Art

A rail system, which permits more than one train to travel on one stretch of track of rail, is generally divided into sections or blocks. The purpose of dividing railroad rails of a rail system into sections is to detect the presence of a train on a section of rail at any given time. Each rail section is electrically isolated from all other sections so that a high electrical resistance can be measured over the rail section when no train is present in that section. When a train enters a rail section, the train will short circuit adjacent railroad rails in which the electrical resistance in the rail section drops, thereby indicating the presence of a train.

Railroad rails are generally welded to each other or attached to each other by a rail joint. Referring to FIG. 1A, a typical rail joint 2 having a rail end 4 of a first rail R1 and another rail end 6 of a second rail R2 is shown. Rail joint 2 is shown having an electrical insulator 8 and is connected by rail joint bar 12 and rail joint bar 10. Rail joint 2 also shows a gap between E-E where the electrical insulator 8 is placed. With reference to FIG. 1B, a cross section of rail joint 2 is shown illustrating a uniform gap width between the rail end 4 and rail end 6.

There are other different uniform gap shapes. In FIG. 2A, an illustration is shown of another rail joint 16 having angled rail ends at 45°. Rail joint 16 has a rail end 18 of a first rail R1' and a rail end 20 of a second rail R2', with an electrical insulator 22 within the gap that is formed between rail end 18 and rail end 20. A cross-sectional view of rail joint 16 shows the rail joint having rail end 18 and rail end 20, with a gap between E'-E' and an electrical insulator 22 within the gap. As shown in FIG. 2A, the width of the gap is still uniform throughout the angled gap. Some prior art arrangements utilize 45° chamfers or small radii along upper and lower rail end edges to prevent sharp edges. Typically, these chamfers and radiused surfaces have a depth and width in the ranges of 0.030"-0.090".

Presently, ends of rails are connected together by rail joints. Typically, as shown in FIGS. 1A, 1B, 2A, and 2B, rail ends abut each other with flat surfaces that form a uniform gap between the rail ends. Over time, the tensile and flexural forces are higher at a center portion of the rail joints where the two railroad rails are joined. Eventually, the forces acting upon the rails deteriorate the insulator between the rails and they become non-insulated and rub up against each other and form short circuits in the rails. Therefore, it is an object of the present invention to overcome this problem.

SUMMARY OF THE INVENTION

The present invention provides for a rail joint arrangement comprising two rails. The rails have adjacent rail ends separated and thereby forming a gap. The gap has a non-uniform width and can be radiused at the top and bottom. The rails have a top end containing a rail head and a bottom end. The gap is defined between the top end and the bottom end of the rails, and the width of the gap is non-uniform throughout its entire length. In addition, the rail joint arrangement comprises at least one electric insulator positioned within the gap. The rail joint arrangement is fastened together by a rail joint bar attaching the two rails together.

The present invention also provides for a rail for use in a rail joint arrangement. The rail includes a rail body, which comprises a first end having a first rail end surface and a second end having a second rail end surface. The rail body contains a cross-sectional profile comprising a head attached to a web portion and the web portion connected to a base. The head is positioned on an opposite side of the web from the base. The rail contains a cross-sectional profile that extends along a vertical axis and the first rail end surface is not completely contained in any flat plane that contains an axis that is parallel to the vertical axis.

The present invention further provides for a method for forming a rail joint that includes providing two rails. Each rail includes a rail body, which comprises a first end having a first rail end surface and a second end having a second rail end surface. The rail body contains a cross-sectional profile comprising a head attached to a web portion and the web portion connected to a base. The head is positioned on an opposite side of the web from the base. The rail contains a cross-sectional profile that extends along a vertical axis and the first rail end surface is not completely contained in any flat plane that contains an axis that is parallel to the vertical axis. The method includes positioning respective rails having a top end and a bottom end adjacent each other to form a gap. The rail ends define a gap between the top end and the bottom end of the rails and the gap width is non-uniform throughout its entire length. Finally, insulating material is placed within the gap and the rails are attached by fasteners, thereby forming a rail joint.

DESCRIPTION OF THE PREFERRED EMBODIMENTS

Figure 3:
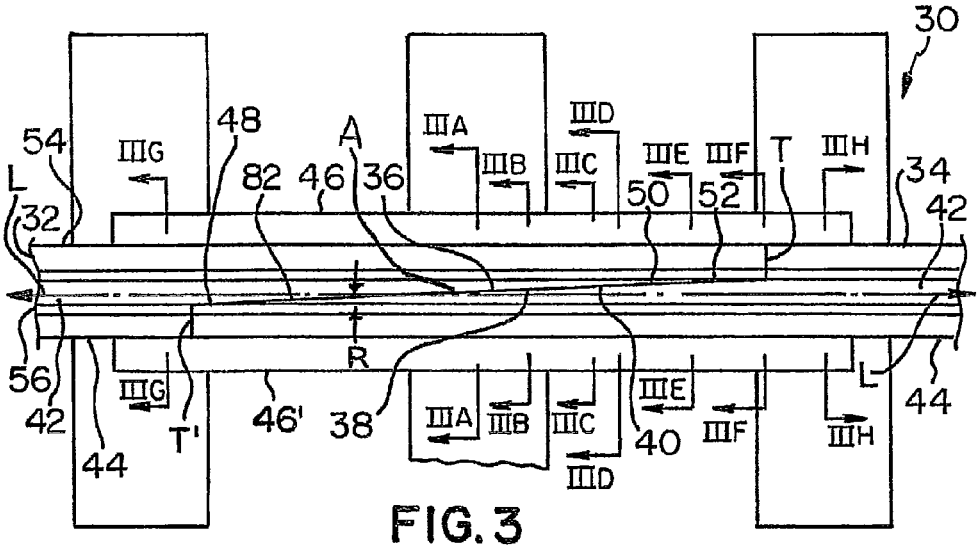
FIG. 3 shows a top plan view of a rail end arrangement made in accordance with the present invention.

Referring to FIG. 3, a rail joint arrangement made in accordance with the present invention shows rail joint 30 having a rail 32 and a rail 34, with rail end surface 36 and rail end surface 38, respectively. The two rails 32, 34 are positioned having the rail end surfaces 36, 38 adjacent each other to form a gap 40 having a width in between them. Rail 32 is a typical rail having a top end 42 and a bottom end 44. The rail joint arrangement is fastened together once an insulator is placed within the gap by a rail joint bar 46 or 46', which extends along the length of the gap 40 in which the insulator is to be placed.

Cross sections IIIA-IIIA, IIIB-IIIB, IIIC-IIIC, IIID-IIID, IIIE-IIIE, IIIF-IIIF, IIIG-IIIG, and IIIH-IIIH, shown in FIGS. 3A-3H, show the rail end surfaces 36 and 38 at various positions taken along the rail joint 30. As is shown, each of cross sections of FIGS. 3A-3H shows rail 32 and rail 34 having a top end 42 and a bottom end 44. Also shown in FIGS. 3A-3H, typical to rails, are the rails having a web portion 60 connected to a head 58 and a base 62, the web portion 60 being intermediate to the head 58 and the base 62. Rail 32 and rail 34 are positioned adjacent each other to form gap 40. As shown in FIG. 3, the complete rail end surfaces 36 or 38 are not contained in a flat plane, for example, plane P that includes line V' that is parallel to line V shown in FIG. 3A and is perpendicular to the drawing surface (extends into the paper) due to the formation of the gap 40 having more than one width. The width of gap 40 is larger at the top end 42 than an intermediate portion 43 or bottom end 44, as is shown in FIGS. 3A-3H. Once the rail end surface 36 and rail end surface 38 are positioned adjacent one another to form gap 40, an electrical insulator 41 can be positioned within the gap 40. The electrical insulator 41 can be made of material such as fiberglass, or a polymeric material such as polyurethane. Once the electrical insulator 41 is placed within gap 40, an electrically-insulating epoxy (not shown in FIGS. 3A-3H) is dispersed into the gap 40 to fill the remaining cavity. Rail joint bar 46 and rail joint bar 46' are attached to the rails 32, 34 by preferably at least one fastener (not shown). Fasteners may be placed through a series of holes in the rail joints and rails to fasten the joints together. Fasteners are placed through the rail joint bar and through the rail and fastened to the rail to form a tight fit. Typically, the fasteners coact with electrically-insulating bushings and washers.

Figure 1A:
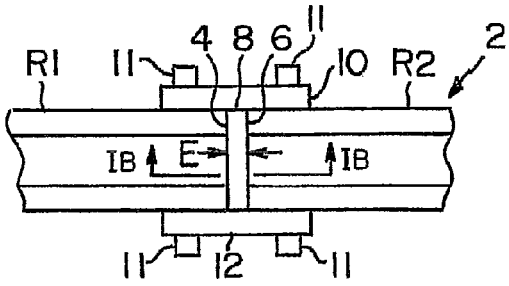
FIG. 1A PRIOR ART
FIG. 1A is a top plan view showing a prior art rail end arrangement having ends that are transverse to the rails.
Figure 1B:
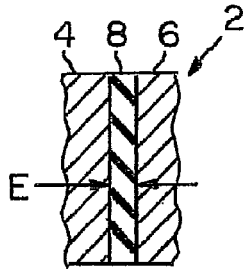
FIG. 1B PRIOR ART
FIG. 1B is a sectional view taken along lines IB-IB of FIG. 1A.
Figure 2A:
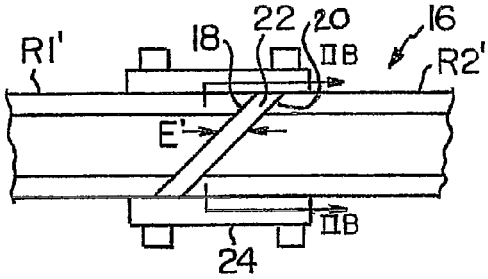
FIG. 2A PRIOR ART
FIG. 2A is a top plan view of a prior art rail end arrangement having ends that are at a 45° angle.
Figure 2B:
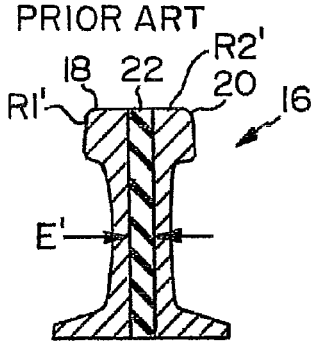
FIG. 2B PRIOR ART
FIG. 2B is a sectional view taken along lines IIB-IIB of FIG. 2A.

With continuing reference to FIG. 3, rail joint 30 is formed by a Z-cut 48 of the rails 32 and 34. The Z-cut 48 includes an angled surface 82 cut along an angled surface axis A and transverse cuts T and T'. Alternatively, the rail joint can be formed by just an angled cut, without the transverse cuts T and T', similar to the 45° angled cut shown in FIG. 2A. The angle range R is defined between a longitudinal axis L and the angled surface axis A.

As shown in FIGS. 3A-3H, a U-shaped profile 45 is formed in the top end 42 when the rail end surfaces 36 and 38 are placed together. The gap 40 is non-uniform. In other words, given a vertical axis V, the rail end surfaces 36 and 38 of the gap 40 in the top end 42 form the U-shaped gap 45 and the rail end surfaces 36 and 38 of the remaining gap 40 cannot be entirely contained in any vertical axis V.

Figure 4:
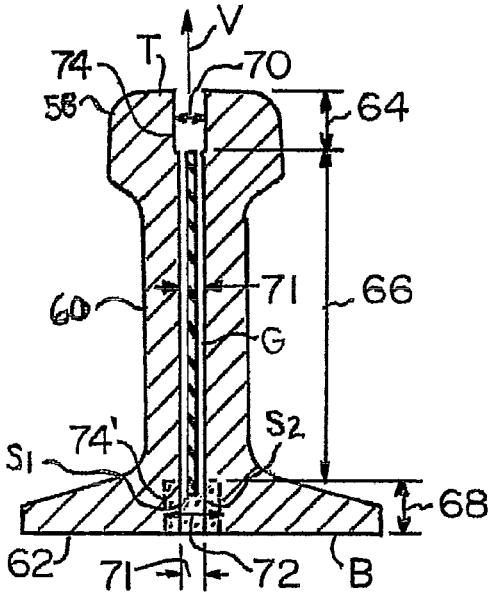
FIG. 4 is an end sectional view of an embodiment of a rail made in accordance with the present invention.

In another preferred embodiment shown in FIG. 4, a top gap width 70 can have a different shaped profile. The cross section in FIG. 4 is taken in a rail joint arrangement having a rectangular-shaped profile 74. The cross section can have a top portion 64, a middle portion 66, and a bottom portion 68. The top portion 64 is shown to have a top gap width 70 wider than intermediate gap width 71 of middle portion 66. In addition, bottom portion 68 is shown having a bottom gap width 72, shown in phantom. When bottom gap width 72 is not present, intermediate gap width 71 of middle portion 66 merely extends down to bottom end B and, therefore, top gap width 70 is wider than the gap width in the bottom portion 68.

Bottom portion 68 is shown having a bottom gap width 72 in phantom, which, when optionally present, is wider than the intermediate gap width 71 of the middle portion 66. The profile of gap G as shown in the top portion 64 and the bottom portion 68 is rectangular-shaped profile 74 and 74' (shown in phantom). The gap in the bottom if optionally present can be any shape, not limited to the shape of the rectangular-shaped profile 74. The gap G is non-uniform in width. In other words, given a vertical axis V and a horizontal axis H, edges S1 or S2 of gap G in the top portion 64 and remaining gap G cannot be entirely contained in any vertical axis V chosen along horizontal axis H. In addition, when present, the edges S1 or S2 of a gap containing optional rectangular-shaped profile 74' in the bottom portion 68 and gap G of the middle portion 66 cannot be contained in any vertical axis V. Additionally, in FIGS. 3A-3H, rail joint 30 comprises a head 58, a web portion 60, and a base 62.

Figure 5:
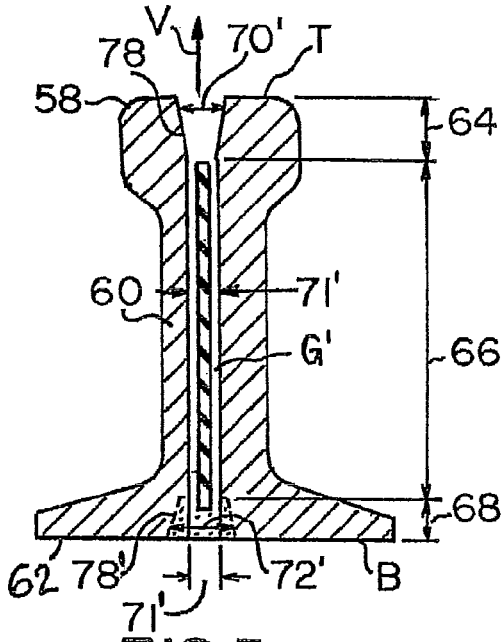
FIG. 5 is an end sectional view of another embodiment of a rail made in accordance with the present invention.

FIG. 5 shows a cross section of a rail joint of another preferred embodiment of the present invention having a trapezoidal-shaped profile 78 and 78' (shown in phantom). Like reference numerals are used for like parts. In FIG. 5, the rail joint is shown having a top portion 64, a middle portion 66, and a bottom portion 68. As shown, the top portion 64 has a top gap width 70' wider than the intermediate gap width 71'. The bottom portion 68 shows, in phantom, a bottom gap width 72', which is also wider than the intermediate gap width 71'. Top gap width 70' and bottom gap width 72' are shown in FIG. 5 to have a trapezoidal-shaped profile 78 and 78'. Additionally, the top gap width 70' can be larger than the bottom gap width 72' or, alternatively, the bottom gap width 72' can be larger than the top gap width 70'. Lastly, top gap width 70' can be equal to bottom gap width 72'. When bottom gap width 72' is not present, intermediate gap width 71' of middle portion 66 merely extends down to bottom end B and, therefore, top gap width 70' is wider than the gap width in the bottom portion 68. It should be noted that profiles 72', 74', and 76' are optional and that, in lieu of these profiles, the intermediate gaps 71, 71', and 71" can extend to the bottom of the rail as shown.

Figure 6:
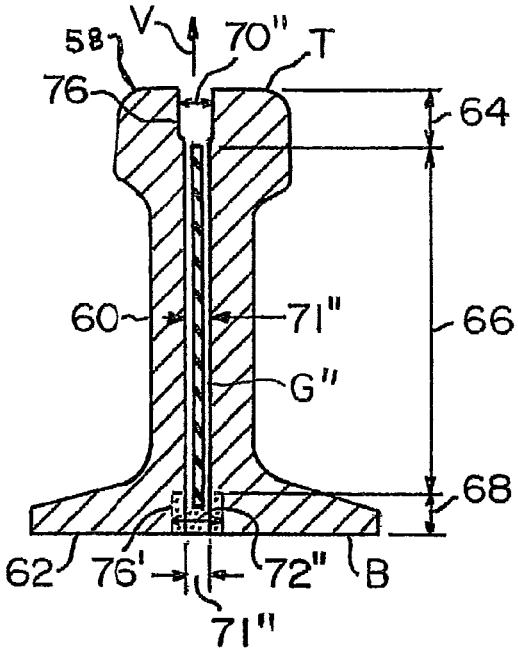
FIG. 6 is an end view of yet another embodiment of an end rail made in accordance with the present invention.

FIG. 6 illustrates a cross section of another embodiment having a U-shaped profile 76 and 76' (shown in phantom). In FIG. 6, the numerals are the same for like parts. The cross section is shown having a top T and a bottom B. The cross section is divided into a top portion 64, a middle portion 66, and a bottom portion 68 to illustrate that the top gap width 70" is wider than the intermediate gap width 71", and bottom gap width 72", shown in phantom, can be wider than the intermediate gap width 71" of middle portion 66. When bottom gap width 72" is not present, intermediate gap width 71" of middle portion 66 merely extends down to bottom end B and, therefore, top gap width 70" is wider than the gap width in the bottom portion 68.

The gap widths as shown in FIGS. 4-6 of the rail joint are larger near the top T and the bottom B so that an epoxy can be applied to the cavity to strengthen the bond.

In addition to the three aforementioned shapes, there can be other types of variations of shapes. For example, one rail end surface could be uniform while the other is angled and, therefore, still forms a non-uniform gap in the top gap width 70 or the bottom gap width 72 or both. Intermediate gap widths 71, 71', or 71" of the middle portion 66 is typically about 1/16", which is the typical thickness of the electrical insulator 41. Preferably, the top gap widths 70, 70', and 70" and bottom gap widths 72, 72', and 72", and the widest portions of top gap widths 70' and 70" and bottom gap widths 72' and 72", should be 1/8" or greater than intermediate gap width 71, 71', or 71". More preferably, top gap widths 70, 70', or 70" and bottom gap widths 72, 72', or 72", and the widest portions of top gap widths 70' and 70" and bottom gap widths 72' and 72", should be within the range of 1/8"-3/16" greater than intermediate gap width 71, 71', or 71" and, even more preferably, 3/16" or greater than intermediate gap width 71, 71', or 71". The gap depth of top portion 64 is preferably 1/2" or greater and, more preferably, within the range of about 1/2" to 1" and, even more preferably, within the range of 1" or greater. The gap depth of bottom portion 68 preferably is greater than 1/4", more preferably within the range of 1/4" to 1/2" and, even more preferably, greater than 1/2".

Figure 9A:
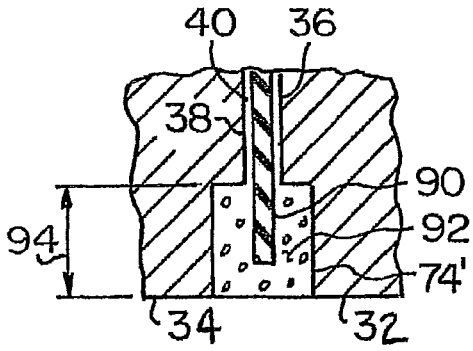
FIGS. 9A-9C are sectional views of lower portions of adjacent rail ends used in rail joints made in accordance with the present invention.

Shown in FIG. 9A is a sectional view of the cross section in FIG. 4 having a rectangular-shaped profile 74' in a bottom portion 94 of the gap 40. The rectangular-shaped profile 74' is shown having an insulator 90 extending into the gap 40 of the bottom portion 94. As shown in FIG. 9A, the rectangular-shaped profile 74' is in the bottom portion 94 of the cross section of FIG. 4, however, a rectangular-shaped profile could alternatively be placed in the top end. An epoxy 92 can be dispersed to the cavity surrounding the extending insulator 90. The epoxy can fill the gap around the extending insulator and thereby provide protection from elements and from flexural forces. The epoxy is electrically insulating.

Figure 9B:
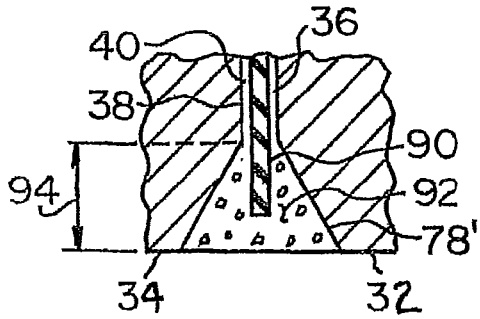

Similar to FIG. 9A, FIG. 9B shows an end sectional view of the embodiment shown in FIG. 5 having a trapezoidal-shaped profile 78'. Trapezoidal-shaped profile 78' is shown with epoxy 92 surrounding the extending insulator 90. Again, in FIG. 9C, a keystone-shaped profile 80' is shown, with bottom portion 94 containing extending insulator 90 surrounded by dispersed epoxy 92.

Figure 7A:
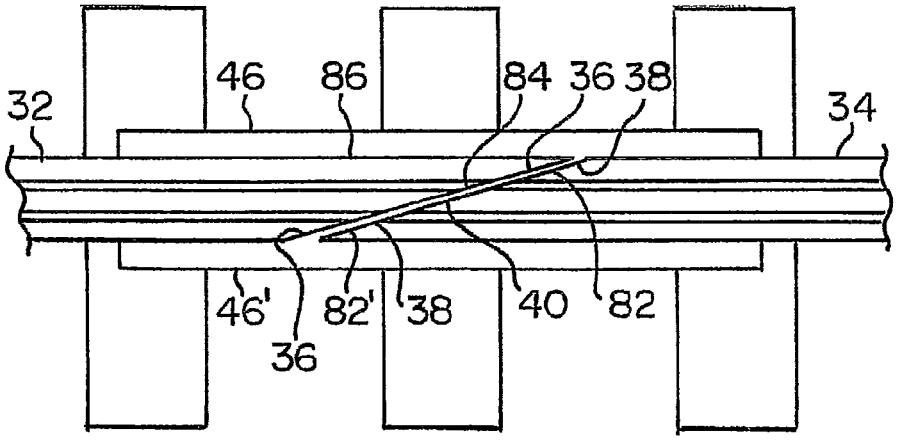
FIGS. 7A-7B are top plan views of different low angle cuts of ends of rail.
Figure 7B:
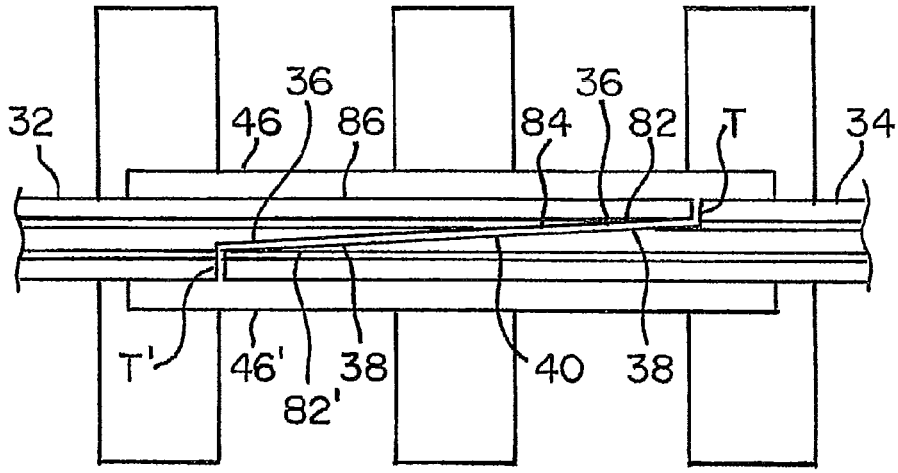

Returning to FIG. 3, the rail joint 30 has an angled gap 40 extending along an angled axis. The angle R as shown can be any angle which is less than 90° between the longitudinal axis L and the angled surface axis A. More preferably, the angle R should be less than 45° and, even more preferably, within the range of 0° to 15°. FIGS. 7A and 7B show two types of gaps that are formed when the rail end surface 36 and rail end surface 38 of rails 32 and 34 are cut having angled surfaces. In FIGS. 7A and 7B, an angled surface 82 and 82' are shown having an angled surface axis 84. FIG. 7A shows a slightly different gap from FIG. 7B.

Figure 8A:
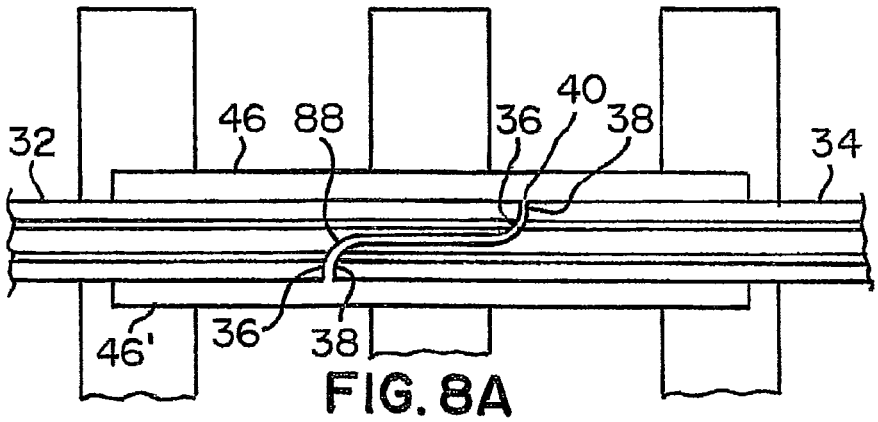
FIGS. 8A-8B are top plan views of different low angle cuts of ends of rails.
Figure 8B:
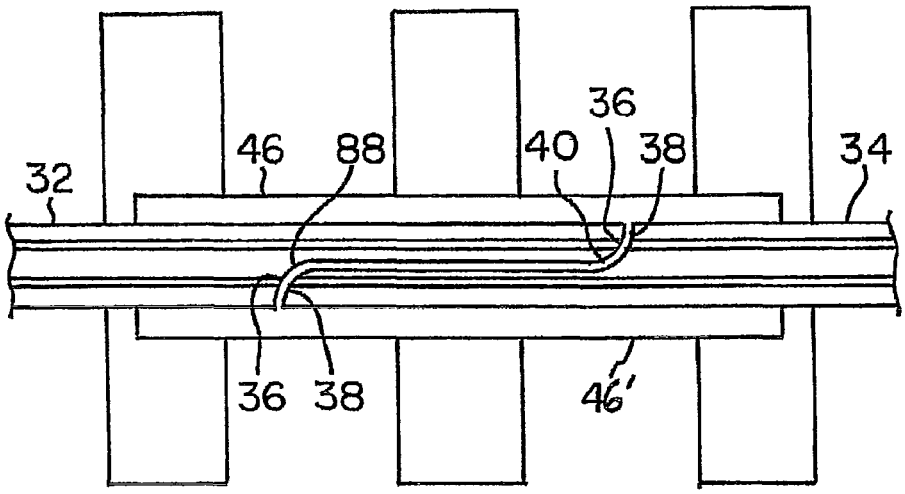

In FIGS. 8A and 8B, a straight cut is shown having an S-shape or Z-shape. FIGS. 8A and 8B show a rail 32 and a rail 34 adjacent each other to form a gap 40. Rail end surface 36 and rail end surface 38 are S-shaped or Z-shaped. Rail end surfaces 36 and 38 form an S-shaped or Z-shaped gap 88 between rail 32 and rail 34.

Figure 3A:
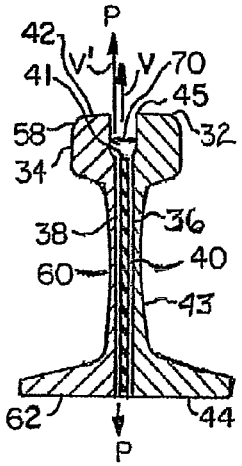
FIGS. 3A-3H are sections taken along lines IIIA-IIIA, IIIB-IIIB, IIIC-IIIC, IIID-IIID, IIIE-IIIE, IIIF-IIIF, IIIG-IIIG, IIIH-IIIH, respectively, of FIG. 3.
Figure 3B:
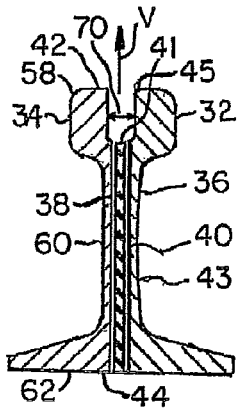
Figure 3C:
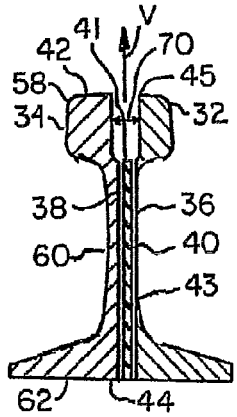
Figure 3D:
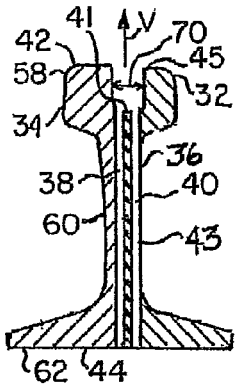
Figure 3E:
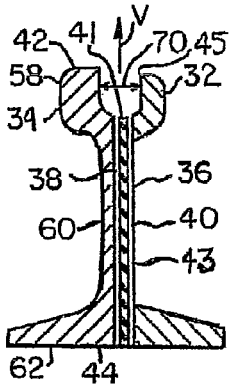
Figure 3F:
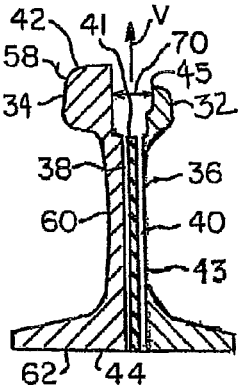
Figure 3G:
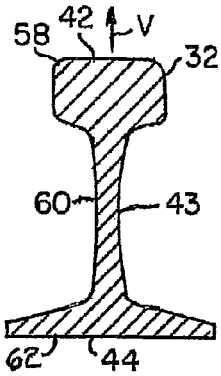
Figure 3H:
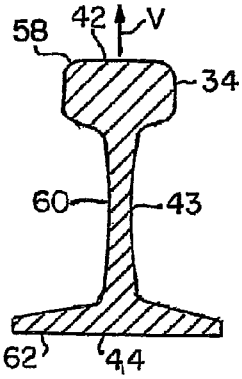

With further reference to FIG. 3, rail 32 is shown having a rail end surface 36 on first end 50 and a first rail end surface 52. In addition, rail 32 has a second end 54 and a second rail end surface 56. Rail 32 is shown in the cross section of FIG. 3A to have a head 58, a web portion 60 attached to a base 62, the web portion connected to a base and the head is positioned on the opposite end as shown. The rail end surface 36 extends from first rail end surface 52 along gap 40. Rail end surface 36 extends across the complete width of the rail. In other words, rail surface 36 extends across the complete width of the head 58, the web portion 60, and the base 62. As previously stated, at no time does a flat plane P contain the complete first rail end surface 36. For that matter, straight vertical line V' does not contact the complete rail cross-sectional profiles, such as shown in FIG. 3A.

The present invention provides for a method of securing two rails 32 and 34, having rail end surface 36 and rail end surface 38. As shown in FIG. 3A, the rail end surface is not contained in a flat plane P parallel to any cross section along an axis for either rail 32 or rail 34.

Next, the respective rails are placed adjacent each other, with a top end 42 and a bottom end 44 of each rail adjacent to the top end 42 and bottom end 44 of the other. The gap 40 formed therein is defined by the rail end surfaces 36 and 38, which are placed adjacent each other. The gap 40 forms a profile at the top and, optionally, at the bottom. Examples of the profile can be rectangular, trapezoidal, or keystone in shape.

Figure 9C:
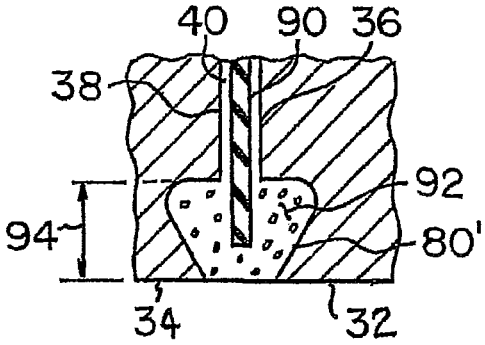

As discussed earlier, the gap 40 can also be wider in the top than the bottom and, alternatively, the gap can be wider in the bottom than the top. After the rails are positioned adjacent each other, an insulating material is placed within the gap. The insulating material can be as shown in FIGS. 9A, 9B, and 9C as an epoxy placed in the top gap or bottom gap to fill the hole that has an extended fiberglass insulator. Next, the rails are attached together, thereby forming a rail joint. In FIG. 3, a rail joint bar 46 is used to fasten the rail joint together. However, any fastener known in the art can be used.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A rail, comprising:

a rail body having a first end having a first rail end surface and a second end having a second rail end surface, the rail body having a head portion, a web portion, and a base portion, the first rail end surface having a height and a length, the height of the first rail end surface extending from a top end of the rail body to a bottom end of the rail body, the first rail end surface defined by the head portion, web portion, and base portion is generally Z-shaped having transverse portions extending in a lateral transverse direction relative to a longitudinal axis of the rail body and an angled portion extending between the respective transverse portions, the transverse portions are spaced from each other in the transverse direction and in a direction that extends parallel to the longitudinal axis of the rail body, wherein the first rail end surface at the head portion of the rail body defines a profile that extends the entire length of the first rail end surface and extends from a top surface of the top end of the rail body towards the bottom end of the rail body, the profile being recessed relative to a portion of the first end surface corresponding to the web portion of the rail body.

2. The rail of claim 1, wherein the profile is configured to define a U-shaped cross-sectional profile along the entire length of the first end surface when the first rail end surface is positioned adjacent to a corresponding end surface of a second rail.

3. The rail of claim 1, wherein the profile is configured to define a rectangular shaped cross-sectional profile along the entire length of the first end surface when the first rail end surface is positioned adjacent to a corresponding end surface of a second rail.

4. The rail of claim 1, wherein the first rail end surface at the base portion of the rail body defines a profile configured to define a frusto-triangular shaped cross-sectional profile along the entire length of the first end surface when the first rail end surface is positioned adjacent to a corresponding end surface of a second rail.

5. The rail of claim 1, wherein the profile is configured to define a trapezoidal shaped cross-sectional profile along the entire length of the first end surface when the first rail end surface is positioned adjacent to a corresponding end surface of a second rail.

6. The rail of claim 1, wherein the first rail end surface at the base portion of the rail body defines a profile configured to define a keystone shaped cross-sectional profile along the entire length of the first end surface when the first rail end surface is positioned adjacent to a corresponding end surface of a second rail.

7. A rail, comprising:

a rail body having a first end having a first rail end surface and a second end having a second rail end surface, the rail body having a head portion, a web portion, and a base portion, the first rail end surface having a height and a length, the height of the first rail end surface extending from a top end of the rail body to a bottom end of the rail body, wherein the first rail end surface at the head portion of the rail body defines a profile that extends the entire length of the first rail end surface and extends from a top surface of the top end of the rail body towards the bottom end of the rail body, the profile being recessed relative to a portion of the first end surface corresponding to the web portion of the rail body, a dimension of said profile measured in a lateral transverse direction of the rail and the height, is less than a corresponding dimension of said rail head portion measured in a transverse direction of the rail, and wherein the profile is configured to define a U-shaped cross-sectional profile along the entire length of the first end surface when the first rail end surface is positioned adjacent to a corresponding end surface of a second rail.

8. The rail of claim 7, wherein the first rail end surface defined by the head portion, web portion, and base portion is generally Z-shaped having transverse portions extending in a lateral transverse direction relative to a longitudinal axis of the rail body and an angled portion extending between the respective transverse portions, the transverse portions are spaced from each other in the transverse direction and in a direction that extends parallel to the longitudinal axis of the rail body.

9. The rail of claim 7, wherein the first rail end surface defined by the head portion, web portion, and base portion is generally S-shaped.

* * * * *

UNITED STATES PATENT AND TRADEMARK OFFICE

CERTIFICATE OF CORRECTION

PATENT NO. : 8,302,878 B2
APPLICATION NO. : 13/037483
DATED : November 6, 2012
INVENTOR(S) : W. Thomas Urmson, Jr. et al.

It is certified that error appears in the above-identified patent and that said Letters Patent is hereby corrected as shown below:

Column 1, Line 9, delete "7,957,933," and insert -- 7,975,933, --

Signed and Sealed this
Fifth Day of February, 2013

Teresa Stanek Rea
*Acting Director of the United States Patent and Trademark Office*